United States Patent [19]

Hessari

[11] 4,287,945

[45] Sep. 8, 1981

[54] PLATE HEAT EXCHANGER

[75] Inventor: Manouchahr F. Hessari, Brighton, England

[73] Assignee: The A.P.V. Company Limited, Crawley, England

[21] Appl. No.: 163,349

[22] Filed: Jun. 26, 1980

[30] Foreign Application Priority Data

Jul. 3, 1979 [GB] United Kingdom ..... 23178/79

[51] Int. Cl.[3] ..... F28D 9/00; F28F 9/22

[52] U.S. Cl. ..... 165/167; 165/174

[58] Field of Search ..... 165/166, 167, 174

[56] References Cited

U.S. PATENT DOCUMENTS

| | | | |
|---|---|---|---|
| 1,748,121 | 2/1930 | Gay | 165/174 X |
| 1,795,055 | 3/1931 | Taylor et al. | 165/174 X |
| 1,958,899 | 5/1934 | MacAdams | 165/174 X |
| 2,099,186 | 11/1937 | Anderegg | 165/174 X |
| 3,908,758 | 9/1975 | Armonies et al. | 165/174 |
| 3,919,858 | 11/1975 | Garland et al. | 165/174 X |
| 4,122,828 | 10/1978 | Di Peri | 165/174 X |
| 4,217,953 | 8/1980 | Sonoda et al. | 165/174 X |

FOREIGN PATENT DOCUMENTS

| | | | |
|---|---|---|---|
| 943948 | 6/1956 | Fed. Rep. of Germany | 165/174 |
| 788045 | 12/1957 | United Kingdom | 165/174 |

*Primary Examiner*—Sheldon J. Richter

*Attorney, Agent, or Firm*—Christel, Bean & Linihan

[57] ABSTRACT

A problem with plate heat exchangers, particularly with a large number of plates arranged in Z formation is the maldistribution which give rise to partial starvation of the flow spaces (3) nearer the inlet end. It is intended to combat this by the provision of a distributor insert (9) in the inlet duct and, if necessary, a collector insert (20) in the discharge duct. The distributor (9) is intended to encourage flow into the flow spaces nearer the inlet end and to inhibit flow into those remote from the inlet end. The collector (20) is intended to increase the local flow velocity near the inlet end to reduce the pressure gradient due to the momentum effect.

Refer to FIG. 2.

16 Claims, 16 Drawing Figures

V
VII

PLATE HEAT EXCHANGER

This invention relates to plate heat exchangers.

A plate heat exchanger, as the term is normally understood, includes a separable pack of gasketed plates arranged in spaced, face-to-face relationship to define flow spaces between adjacent plates. The plates have aligned holes or ports which form ducts for the supply and discharge of media, the gasketing being so arranged that the supply and discharge ducts of one medium are in communication with alternate flow spaces while those of the other medium are in communication with the intervening flow spaces.

The plates are normally pressed out from sheets of corrosion-resistant material such as stainless steel or titanium.

One problem arising with plate heat exchangers, particularly with large numbers of plates in a pass is that the flow of either or both media will not be evently distributed between the flow spaces arranged in parallel. This phenomenon is known as port losses and leads to deviation from designed performance and possible damage to feed liquids, e.g. food liquids, which may be vulnerable to thermal degradation. The under-use of particular flow spaces leads to an unnecessarily high pressure drop across the heat exchanger, with consequent wastage of power or reduction in flow.

The nature of the maldistribution varies with the arrangement. With a symmetric or U arrangement, in which the flow feed and discharge for the medium in question are at the same end of the pack of plates forming the pass, the easier flow path, which is therefore preferentially used, is in flow passages nearer the feed and discharge end. In an asymmetric or Z arrangement, when the feed into the inlet duct is at the appropriate end to the discharge from the discharge duct, a different problem arises.

In the Z arrangement, it can be shown that the maldistribution takes the form of more or less severe starvation of the flow spaces nearer the inlet. This has been verified by experiment and it can be understood by considering the ducts of a plate heat exchanger as very rough pipes. This gives rise to an effect of a pressure drop along the length of the inlet duct away from the feed end and along the length of the discharge duct towards the discharge end. In addition there is the momentum effect arising from the change in fluid flow rate, i.e. a drop in the flow rate in the inlet duct in the direction away from the inlet end and a rise in the flow rate in the discharge duct towards the discharge end. The variations in pressure due to these effects are in opposite directions in the inlet duct giving rise to a difference effect. However, they are in the same direction in the discharge duct giving rise to an additive effect.

The net result of this in a Z (asymmetric) arrangement of plates is a fairly constant, either slightly falling or rising, pressure along the inlet duct away from the feed end. In the discharge duct the pressure falls sharply towards the outlet end, which is opposite to the feed end of the inlet duct. Accordingly, the greater pressure drop is near the discharge end of the pack, so that flow is preferentially taking place at and near that end of the pack and the flow spaces at the feed end are partially starved. With heat exchangers having a comparatively small number of plates, i.e. up to a few dozen, this is perhaps not as significant as it is with a large number of plates in a pass, e.g. some hundreds.

The present invention is directed to a solution of the distribution problem in plate heat exchangers of the Z or asymmetrical arrangement.

According to the present invention there is provided a plate heat exchanger comprising a pack of plates arranged in spaced face-to-face relationship to define flow spaces between adjacent plates, the plates having aligned holes therein which form ducts for the supply and discharge of media to and from the flow spaces, the arrangement of the ducts for at least one medium being of asymmetric or Z arrangement with the supply and discharge ducts being fed from and discharged to opposite ends of the pack, in which an insert is provided in the supply duct for the said at least one medium to assist in distribution of the medium along the pack of plates by inhibiting the flow to the flow spaces near the end of the pack remote from the inlet end of the supply duct.

Preferably, the insert is in the form of a tube extending from a point part way along the inlet duct to near the said remote and thereof. The tube may be of a diameter to occupy rather less than one half of the cross sectional area of the duct and may have a flow-blocking annulus located just past half way along the duct. Upstream of the annulus the tube may have external fins, preferably radial, which support the tube and also partition the flow so that only a portion of the exterior of the tube is in free communication with the flow spaces.

The end of the tube adjacent the remote end of the feed duct may be fitted with an outer shroud so that fluid entering the most remote flow spaces must reverse twice. The outer shroud may also abut further external fans partitioning the flow.

In order to control the flow in the discharge duct, a further insert, or collector, may be located therein to provide localised acceleration of the flow to reduce the pressure gradient due to the momentum effect.

This insert may also be in the form of a tube having a closed end remote from the discharge end of the duct and extending from that end towards, but not wholly as far as, the end of the duct. The collector tube may have an external flow-inhibiting annulus, radial fins on the side of the annulus remote from the discharge end and a large inlet aperture between the closed end and the annulus.

Various other form of collector or distributor may also be used to achieve the desired end, and the exact form of these insets will depend on the values of the various operating parameters.

The invention will be further described with reference to the accompanying diagrammatic drawings, in which:

FIGS. 1*a*, 1*b*, and 1*c* are diagrams showing a typical Z arrangement and the pressure and flow distribution patterns thereof;

Figure 1A:
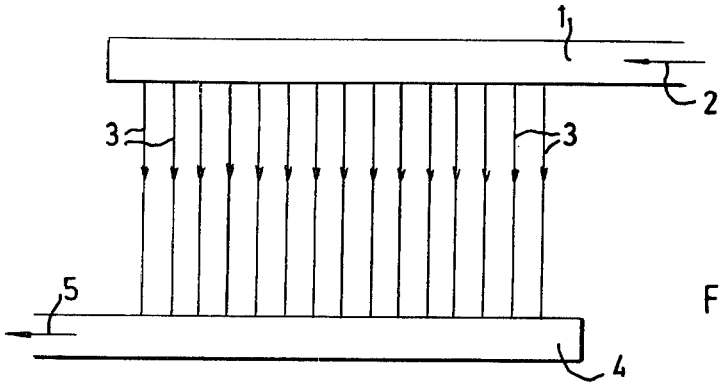
Figure 1B:
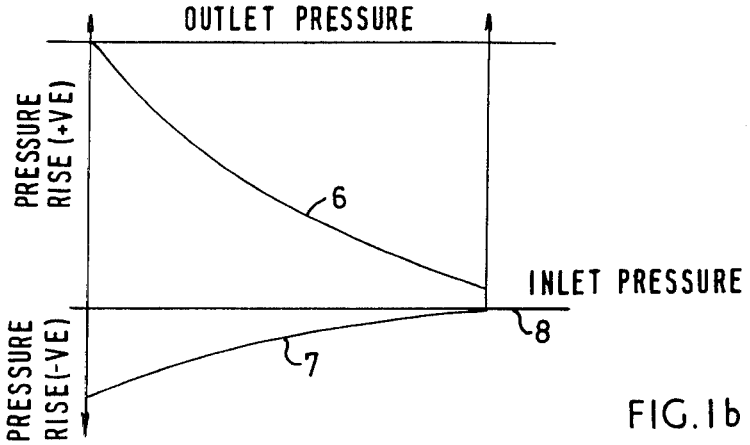
Figure 1C:
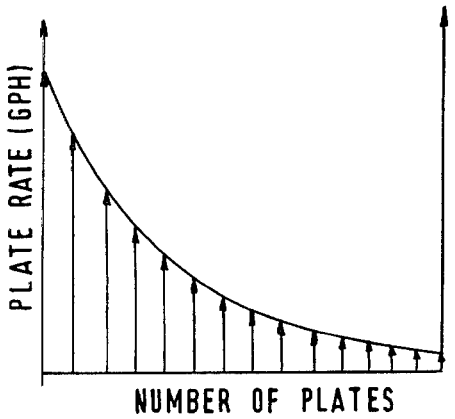

Turning first to FIGS. 1*a*, 1*b* and 1*c*, FIG. 1*a*, is a diagram showing the broad outline of the flow arrangement in a typical asymmetrically arranged (Z arrangement) plate heat exchanger. A medium enters an inlet port 1 in the direction indicated by the arrow 2, passes into the flow spaces arranged in parallel and indicated by the line 3, and then flows into an outlet port or duct 4 and flows out in the direction indicated by the arrow 5. Only a comparatively small number of flow spaces are indicated by lines 3, and it will be appreciated that a pass may contain some hundreds of plates. Also, it is to be appreciated that the flow spaces for only one medium are shown and these will be interleaved with flow spaces for the other medium. In FIG. 1*b*, the curve 6 illustrates the pressure gradient in the outlet duct 4, with the pressure drop indicated as a positive quantity. The curve 6 shows that the pressure falls, i.e. the pressure drop rises, quite sharply towards the exit end in the direction of the arrow 5 due to the additive effect of the frictional resistance due to the rough pipe characteristics of the duct 4, and the pressure drop due to the increase in flow velocity as greater volumes enter the duct 4, nearer the exit end. The curve 7 shows, on a similar basis, the pressure gradient in the inlet duct 1, using the inlet pressure as a base line 8. As explained above, the pressure drop due to flow resistance and the pressure rise due to the momentum effect act in opposition, so that the curve 7 is less steep than the curve 6 and in fact the pressure at the extreme end of the inlet duct 1 is rather higher than the pressure at the inlet. The difference between the two curves is thus the pressure drop across the flow space itself at that position, and it will be seen that the pressure drop is very high near the outlet end and is at a much lower level at the flow spaces close to the inlet end. This being the case, the flow rate is much lower in the flow spaces nearer the inlet end, and this is illustrated in FIG. 1*c* which shows a typical distribution of the flow rate as between the low level on the plates at the right hand side near the inlet end and a much higher level in the plates on the right hand side near the outlet. It will be seen for instance that the flow through the plates near the outlet is several times as great as that through the plates near from the inlet.

These data have been derived by experimental measurement, and have been given without dimensions or values since these vary very much with the particular values adopted for the various parameters, but it will be appreciated that the general tendency with a Z or asymmetrical arrangement is similar.

Figure 2:
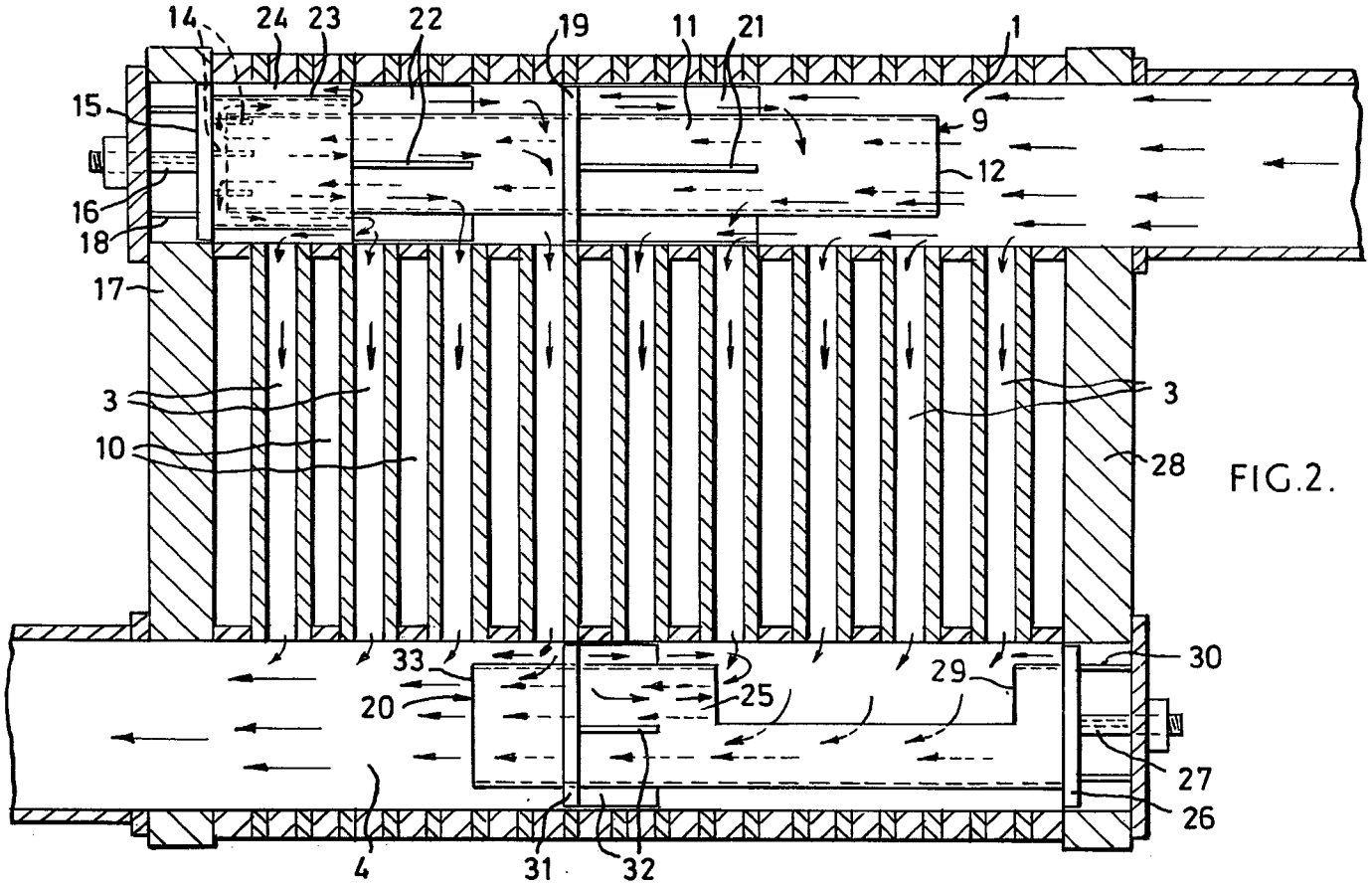
FIG. 2 is a sectional view of a Z form of plate heat exchanger showing a distributor and a collector in the inlet and discharge ducts respectively.

FIG. 2 is a diagram showing in section a Z plate arrangement with a fairly small number of plates for ease of illustration, and in a practical case the invention is likely to be applied to heat exchangers with a much greater number of plates than the twenty or so illustrated. The inlet duct is again illustrated at 1 and the flow spaces connected thereto by 3, the flow in these flow spaces being indicated by arrows. The outlet duct is shown at 4. The intervening flow spaces are illustrated at 10. FIG. 2 also shows in the inlet duct a flow controlling insert or distributor generally indicated at 9 and illustrated in more detail in FIGS. 3 to 5. In the outlet duct 4 there is shown a flow controlling insert or collector 20 which is illustrated in more detail in FIGS. 6 and 7. The purpose of the inserts 9 and 20 is to change the flow pattern so that the pressure drop over each of the flow spaces 3 is substantially similar, thus leading to a greater utilisation of the available flow capacity of the heat exchanger as a whole and the greater uniformity in the heat transfer. This is done essentially by providing a number of inhibition or restrictions to flow through the flow spaces 3 remote from the inlet end of the duct 1, and encouragement of flow to the flow spaces near that end.

Figures 3, 4, 5, 6, 7, 8:
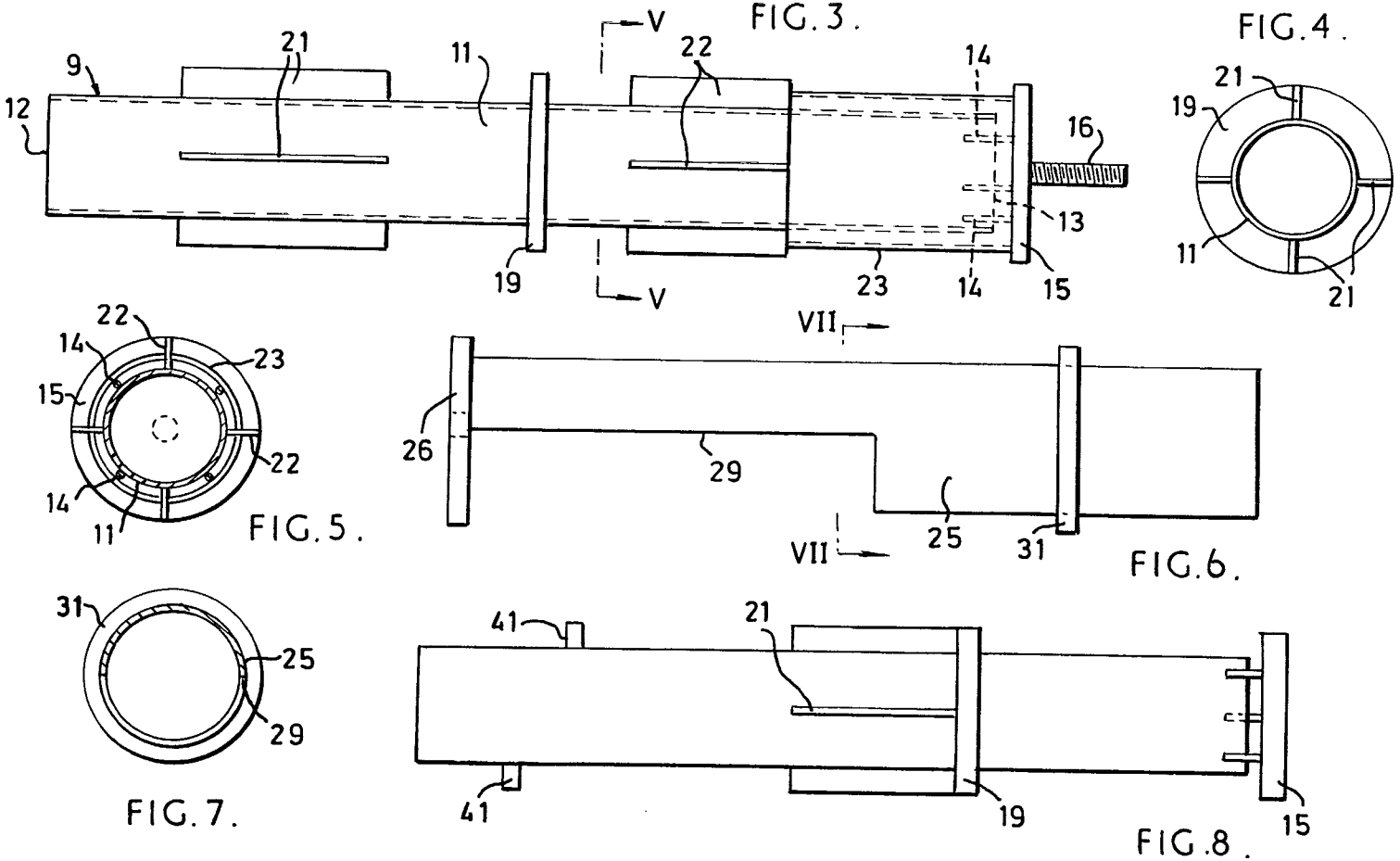
FIG. 3 is an elevation of a distributor similar to that shown in FIG. 2.
FIG. 4 is a view on the arrow "A" of FIG. 3.
FIG. 5 is a section on the line V—V of FIG. 3.
FIG. 6 is an elevation of a collector similar to that shown in FIG. 2.
FIG. 7 is a section on the line VII—VII of FIG. 6.
FIG. 8 is an elevation showing an alternative form of distributor.

Turning now also to the FIGS. 3 to 5, the distributor 9 shown there in a slightly modified version differs somewhat from that of the version shown in FIG. 2, but the principal components are similar although spacings and dimensions have been altered. The distributor 9 is shown as incorporating a tube 11 having an open inlet end 12 adapted to be located at a point somewhat downstream from the inlet end of the inlet duct 1 as illustrated in FIG. 2. The actual position will vary in accordance with the operating parameters. The opposite end 13 of the tube 11 is connected by rods 14 to a locating disc 15 which carries a stud or bolt 16 for securing to the head or follower 17 of the heat exchanger frame. If required, the locating disc may also carry spacers 18 (shown only in FIG. 2).

Part way along its length, the tube 11 carries an external annulus 19 which substantially prevents flow along the outside of the tube 11 within the duct 1. Between the inlet 12 of the tube 11 and the annulus there are provided a group of elongated radial fins 21. In FIG. 2, these are shown as contiguous with the annulus 19, whereas in FIG. 3 they have been shifted to a position between the end 12 and the annulus 19 but terminating short of the annulus 19. The radial dimension of the fins 21 is such that they present a substantial partitioning of the zone of the duct 1 outside the tube 11. On the downstream side of the annulus 19, there is provided a set of fins 22, spaced from the annulus 19 and abutting at their downstream ends with an outer tube 23 which is attached to the disc 14 and extends coaxially with the tube 11. The dimension of the tube 23 is such as to leave a very limited flow zone 24 between its outer diameter and the inner dimensions of the duct 1.

FIGS. 6 and 7 show the collector 11 in a version slightly different from that of FIG. 2. The collector 11 comprises a tube 25 having one end closed by a locating disc 26 which is shown in FIG. 2 as having a stud 27 for securing the disc 26 to the head or follower 28, at the end remote from the exit end. Spacers 30 are also shown in FIG. 2. The inlet to the tube 25 is a semi-diametral cutout 29 which is shown in FIG. 2 as starting a short distance from the locating disc 26 and in FIG. 6 as extending from the disc 26. The tube 25 is dimensioned to leave a fairly restricted flow space in the duct for outside the tube, and partway along its length it is provided with an annulus 31 which substantially blocks flow outside the tube. On the upstream side of the annulus, the collector of FIG. 2 is shown as having fins 32, although these are omitted from the version shown in FIG. 6. The fins are dimensioned so that they substantially partition the flow outside the tube 25. The open end 33 of the tube 25 is located between the annulus 31 and the outlet end of the discharge duct 4.

As mentioned above, the function of the distributor 9 and collector 20 is essentially to encourage flow through the flow spaces nearer the inlet end, and it will be seen that a comparatively large flow space outside the tube 11 ensures, in conjunction with the blocking effect of the annulus 19, that the appropriate proportion of the inlet flow is distributed over the flow spaces upstream of the annulus 19. The first flow spaces in this zone are those exposed to the full flow, and there then follows a group which can draw only from the flow outside the tube 11. The flow spaces nearest the annulus can in fact only draw from a restricted proportion of the flow outside the tube 11 owing to the partitioning effect of the fins 21 which, in conjunction with the blocking effect of the annulus 19 tend to cause flow in this area to reverse back into the intermediate zone. This three way splitting of the zone of the duct upstream of the annulus 19 tends to distribute the flow over the flow spaces more evenly. The inlet flow entering the tube 11 passes right through the length of it to the outlet end adjacent the disc 15 where it has to reverse and flow between the tubes 11 and 23. On emerging from the tube 23, some of the flow reverses towards the end flow spaces which have an outlet pressure at a minimum owing to the momentum efect, and the remainder of the flow passes between the fins 22, so that only a proportion is availble to enter the flow spaces in the region of the fins 22. The remainder of this flow continues towards the annulus 19 and enters the flow spaces between the end of the fins and the annulus. It will be recalled that the pressure gradient in the outlet duct 4 is fairly steep so that the restriction to flow offered by the double reversal required by the presence of the tube 23, and the restriction offered by the fins 21 also tends to even out the distribution as between the flow spaces downstream of the annulus 19.

The function of the collector 20 is essentially to provide a greater flow velocity at the outlet ends of the flow spaces, so as to increase the effect of momentum is enhanced, again so as to tend to increase the flow through the flow spaces debouching adjacent the collection. The annulus 31 is provided to prevent too great an accumulation of flow at one one zone, and also to provide a certain amount of reverse pressure gradient between the annulus 31 and the inlet 29 to the tube 25. The annulus 31 also has a supporting function. The fins 32 tend to increase the velocity immediately adjacent the annulus 31 by partitioning the flow space.

As explained, the variation of the position of the fins 21 can be used to vary the flow of pattern, and the omission of the fins 32 and the other minor modifications mentioned also vary the flow pattern in accordance with the requirements. In particular, it is to be noted that in FIG. 2 the annulus 19 and the annulus 31 are located at substantially the same position in their respective ducts. In certain circumstances, it may be desirable to offset these annuli, and in such a case modifications would be necessary to deal with the change in the flow pattern arising from this variation.

Turning now to FIG. 8, this shows a variation of the distributor in which the fins 21 abut the annulus 19 and in which in addition pins or small fins 41 are provided upstream of the fins 21. Their function is largely one of support. In addition, it is to be noted that the outer tube 23 is omitted, as are the fins 22. In this arrangement, the annulus 19 is moved rather closer to the locating disc 15. The number of different phases of distribution is thus reduced but this type of distributor may be effective to provide a substantial improvement in distribution in certain cases.

Figure 9:
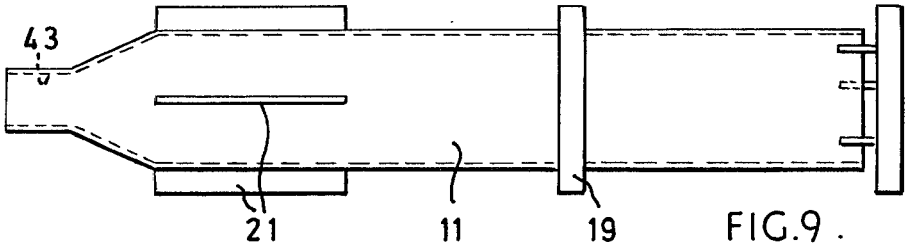
FIG. 9 is a similar view showing a further form of distributor.

FIG. 9 shows a further variation of distributor, again with the outer tube 23 omitted, but the principal variation in this case is that the inlet to the distributor tube 11 is provided with a reduced diameter portion 43 so as to provide a different form of restriction to flow into the tube 11. Fins 21 are shown in this variation as being well spaced from the annulus 19 and commencing close to the beginning of the full diameter zone of the tube 11.

Figure 10:
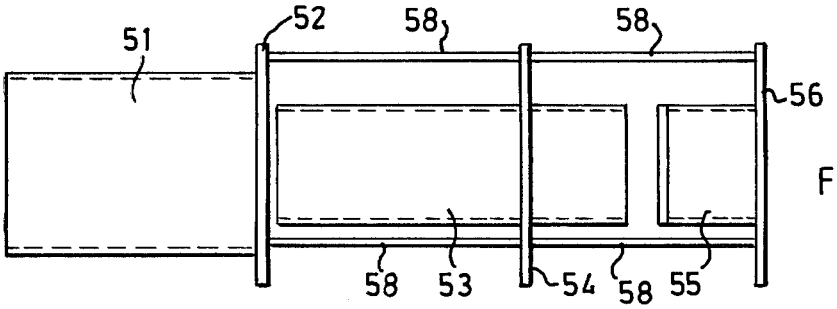
FIG. 10 is an elevation showing a yet further form of distributor.

A further variation of distributor is shown in FIG. 10 in this one, a large diameter tube 51 forms the upstream end of the distributor and this terminates at an annulus 52. Immediately downstream of the annulus is a small diameter coaxial tube 53 which passes through an annulus 54. The outlet end of the tube 53 debouches adjacent a blocked or closed tube 55 attached to a locating disc 56. The annuli 52 and 54 and the disc 56 are joined by connecting rods 58, of which three or more are provided spanning each pair of annuli or discs to be linked. Although the tubes 53 and 55 are shown of the same diameter, they may be different. It would be seen that this type of distributor provides for four different zones of the inlet duct, in addition to a zone which would be upstream of the tube 51.

Figure 11:
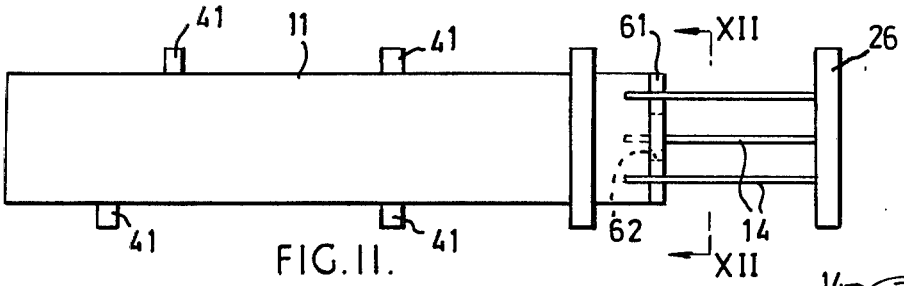
FIG. 11 is an elevation showing a still further form of distributor.
Figure 12:
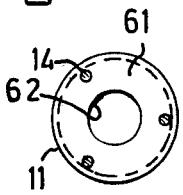
FIG. 12 is a section on the line XII—XII of FIG. 11.

In the version of the distributor shown in FIGS. 11 and 12, the fins 21 on the tube 11 are replaced by pins or short fins 41 distributed as required, and the restriction provided by the external or second tube 23 is instead provided by a restricted open end at the outlet end of the tube 11. As illustrated, the outlet end of the tube 11 is provided with a disc 61 having a single central opening 62, but if required this could be replaced by two or more openings. In this case, the tube terminates some way short of the locating disc 26 and is secured thereto by connecting rods somewhat longer than those illustrated in FIG. 2 and FIG. 3.

Figure 13:
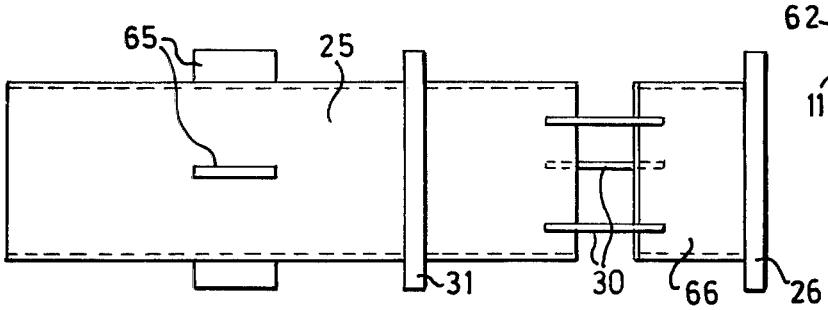
FIG. 13 is an elevation showing an insert which can be used either as a distributor or a collector.

FIG. 13 shows a modified form of collector comprising a tube 25 having an annulus 31 with some fins 65 downstream thereof. In order to provide a restricted inlet to the tube 25 on the upstream side of the annulus 31, a short length of closed tube 66 is attached to the locating disc 26 and connected to the tube 25 by means of connecting rods or strips 30.

Figure 14:
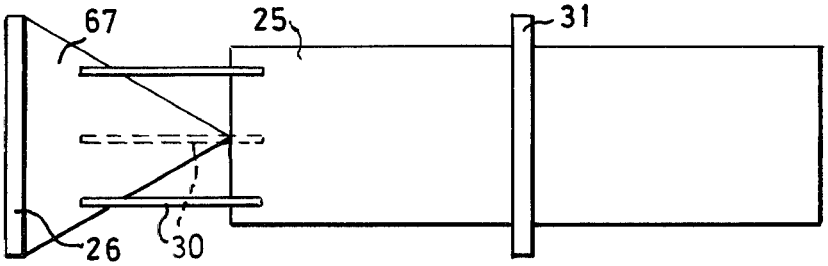
FIG. 14 is an elevation showing an alternative form of insert for either use.

In FIG. 14 there is shown a further variation in which the restricted entrance to the tube 25 is provided by a cone or profiled wedge 67 attached to the locating disc 26 and secured to the tube 25 by means of the connecting rods or strips 30. It may in fact be possible to provide adequate control of the flow and restriction of the entrance to the tube 25 by omitting either the wedge 67 or the short length of tube 66 and bringing the locating disc reasonably close to the open end of the tube 25 to provide the appropriate restriction.

The inserts of FIGS. 13 and 14 may, if required, be used also as collectors.

Various modifications may be made within the scope of the invention.

I claim:

1. In a plate heat exchanger comprising a pack of plates arranged in spaced face to face relationship to define flow spaces between adjacent plates, the plates having aligned holes therein which form ducts for the supply and discharge of media to and from the flow spaces, the arrangement of the ducts for at least one medium being of asymmetric or Z arrangement with the supply and discharge ducts being fed from and discharged to opposte ends of the pack; the improvement that an insert is provided in the supply duct for the said at least one medium to assist in distribution of the medium along the pack of plates by inhibiting the flow to the flow spaces near the end of the pack remote from the inlet end of the supply duct.

2. A plate heat exchanger as claimed in claim 1, in which the insert is in the form of a tube extending from a point part way along the inlet duct to near the said remote end thereof and of a diameter to occupy rather less than one half of the cross-sectional area of the duct.

3. A plate heat exchanger as claimed in claim 2, in which the tube has a flow-blocking external annulus located part way along the duct.

4. A plate heat exchanger as claimed in claim 3, in which the tube has external fins upstream of the annulus to support the tube and partition the flow.

5. The plate heat exchanger as claimed in claim 2, in which the end of the tube adjacent the remote end of the feed duct is fitted with an outer shroud so that fluid entering the most remote flow spaces must reverse direction twice.

6. A plate heat exchanger as claimed in claim 5, in which the outer shroud abuts further external partitioning fins.

7. A plate heat exchanger as claimed in claim 2, in which the tube also has external pins or short fins to locate it radially.

8. A plate heat exchanger as claimed in claim 2, in which the inlet end of the tube is of reduced diameter to limit ingress of fluid to the interior.

9. A plate heat exchanger as claimed in claim 2, in which the outlet end of the tube is of restricted size.

10. A plate heat exchanger as claimed in claim 2, in which the outlet end of the tube opens onto a spreader mounted on a locating plate.

11. A plate heat exchanger as claimed in claim 1, in which the insert is in the form of first and second tube lengths, open at both ends and mounted seriatim on a supporting structure.

12. A plate heat exchanger as claimed in claim 11, in which each tube length is provided with an external flow-blocking annulus forming part of the supporting structure.

13. A plate heat exchanger as claimed in claim 1, in which a further insert forms a collector in the discharge duct to provide localised acceleration of the flow to reduce the pressure gradient due to the momentum effect.

14. A plate heat exchanger as claimed in claim 13, in which the collector is in the form of a tube having a closed end remote from the discharge end of the duct and extending from that end towards, but not wholly as far as, the end of the duct.

15. A plate heat exchanger as claimed in claim 14, in which the collector tube has an external flow-blocking annulus part way along its length.

16. A plate heat exchanger as claimed in claim 15, in which the collector tube has radial external fins on the side of the annulus remote from the discharge end.

* * * * *